US005984555A

United States Patent [19]

Samad

[11] Patent Number: 5,984,555

[45] Date of Patent: Nov. 16, 1999

[54] DUAL TOILET BRUSH

[76] Inventor: Vicar Samad, 24 Turnberry, Williamsville, N.Y. 14211

[21] Appl. No.: 09/165,324

[22] Filed: Oct. 2, 1998

[51] Int. Cl.[6] ..... A46B 11/02; A47L 13/12

[52] U.S. Cl. ..... 401/176; 401/15; 401/177; 401/192; 401/285; 401/287; 401/290; 15/164

[58] Field of Search ..... 401/176, 177, 401/182, 15, 192, 285, 287, 290; 15/164

[56] References Cited

U.S. PATENT DOCUMENTS

| | | | |
|---|---|---|---|
| 29,805 | 8/1860 | Middleton | 401/176 |
| 203,256 | 5/1878 | Frobisher | 401/176 |
| 908,823 | 1/1909 | Wiens | 15/164 |
| 1,660,318 | 2/1928 | Anderson . | |
| 1,715,907 | 6/1929 | Dragelin | 401/15 |
| 1,848,868 | 3/1932 | Churchill . | |
| 2,242,004 | 5/1941 | Kapinos . | |
| 2,250,758 | 7/1941 | French | 401/176 |
| 3,519,364 | 7/1970 | Truhan | 401/177 |
| 4,578,055 | 3/1986 | Fisher | 401/176 X |
| 5,440,775 | 8/1995 | Banks . | |

*Primary Examiner*—Steven A. Bratlie
*Attorney, Agent, or Firm*—Michael I. Kroll

[57] ABSTRACT

A dual toilet brush (10) comprising an elongate handle (12). A first brush head (14) is connected to a first end of the elongate handle (12) for cleaning an interior surface (16) of a bowl (18) of a toilet (20). A second brush head (22) is connected to and extends outwardly from the first end of the elongate handle (12) above the first brush head (14), for cleaning an overhanging rim (24) of the toilet (20).

7 Claims, 4 Drawing Sheets

52
56
34
10
58
50
BLEACH
46
54
48
12
24
38
44
36
32
22
34
54
40
30
50
14
16
26
42
10
18
46
20
28
12
38
48

8
34
46
50
60
48
38
10
12
20
24
22
32
30
40
26
14
28

(OPTIONAL SPLASH SHIELD)

DUAL TOILET BRUSH

BACKGROUND OF THE INVENTION

1. Field of the Invention

The instant invention relates generally to toilet bowl cleaning apparatuses and more specifically it relates to a dual toilet brush. The dual toilet brush contains a first brush head and a second brush head on an elongate handle to clean an interior surface of a bowl and an overhanging rim of a toilet more efficiently.

2. Description of the Prior Art

Numerous toilet bowl cleaning apparatuses have been provided in prior art. For example, U.S. Pat. No. 1,660,318 to Anderson; U.S. Pat. No. 1,848,868 to Churchill; U.S. Pat. No. 2,242,004 to Kapinos and U.S. Pat. No. 5,440,775 to Banks all are illustrative of such prior art. While these units may be suitable for the particular purpose to which they address, they would not be as suitable for the purposes of the present invention as heretofore described.

ANDERSON, JESSE I.

*COMBINATION BOWL AND RIM BRUSH*

U.S. Pat. No. 1,660,318

A brush comprising a handle having shoulder means adjacent one end thereof. Annular bunches of bristles are secured along the end of the handle by binding. The bristles of the outer annular bunch extend beyond the end of the handle. The bristles of the inner bunch project rearwardly and are deflected outwardly by the shoulder means.

CHURCHILL, THADDEUS R.

*BRUSH*

U.S. Pat. No. 1,848,868

In a brush, a handle stick and a set of bristles are bent back upon themselves to provide two layers of bristles joined by an annular protruding collar portion formed by the bends in the bristles. A binding is wrapped around the bristles between the layers thereof within the collar. A binding encircles both layers between the collar and the head end of the stick. An outer layer of bristles encircles the previously mentioned bristles. A binding encircles the outer layer just between the collar and the head end of the stick and draws the intermediate regions of the outer bristles into the hollow between the collar and the head end of the stick. The outer layer projects rearwardly and are held in a flared position by the collar to form a skirt.

KAPINOS, FRANK J.

*COMBINATION BOWL AND RIM BRUSH*

U.S. Pat. No. 2,242,004

A combination bowl and rim brush comprising a handle. Multiple layers of overlapping bristles are bound adjacent one end of the handle. The bristles extremities of the layers extend forwardly over the end of the handle, to provide the bowl cleaning portion of the brush. An outer layer of multiple relatively spaced clusters of bristles are bound to the handle adjacent the end. The bristles extremities of the clusters extend rearwardly away from the end, to provide spaced tufts of the rim cleaning portion of the brush.

BANKS, KATHERINE L.

*TOILET BOWL SCRUBBER*

U.S. Pat. No. 5,440,775

A toilet bowl scrubber having a handle with a linear configuration, a first brush connected to one end of the handle, an arm extending outwardly of the handle between the first brush and an opposite end of the handle, and a second brush affixed to an end of the arm opposite the handle. The first brush has tufts of bristles affixed thereto extending perpendicular to a longitudinal axis of the handle. The arm includes a first arm portion extending outwardly perpendicular to the handle and a second arm portion extending in a direction from the first arm portion away from the first brush. The second brush is affixed to an end of the second arm portion opposite the first arm portion. The second arm portion extends upwardly at a 45 degree angle from the first arm portion.

SUMMARY OF THE INVENTION

A primary object of the present invention is to provide a dual toilet brush that will overcome the shortcomings of the prior art devices.

Another object is to provide a dual toilet brush that contains a first brush head and a second brush head on a lower end of an elongate handle, which are configured to clean an interior surface of a bowl and an overhanging rim of a toilet more efficiently.

An additional object is to provide a dual toilet brush in which the elongate handle is a curved hollow tube having a syringe dispenser on an upper end for supplying bleach to the first brush head and the second brush head, so as to enhance cleaning of the interior surface of the bowl and the overhanging rim of the toilet.

A further object is to provide a dual toilet brush that is simple and easy to use.

A still further object is to provide a dual toilet brush that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 1:
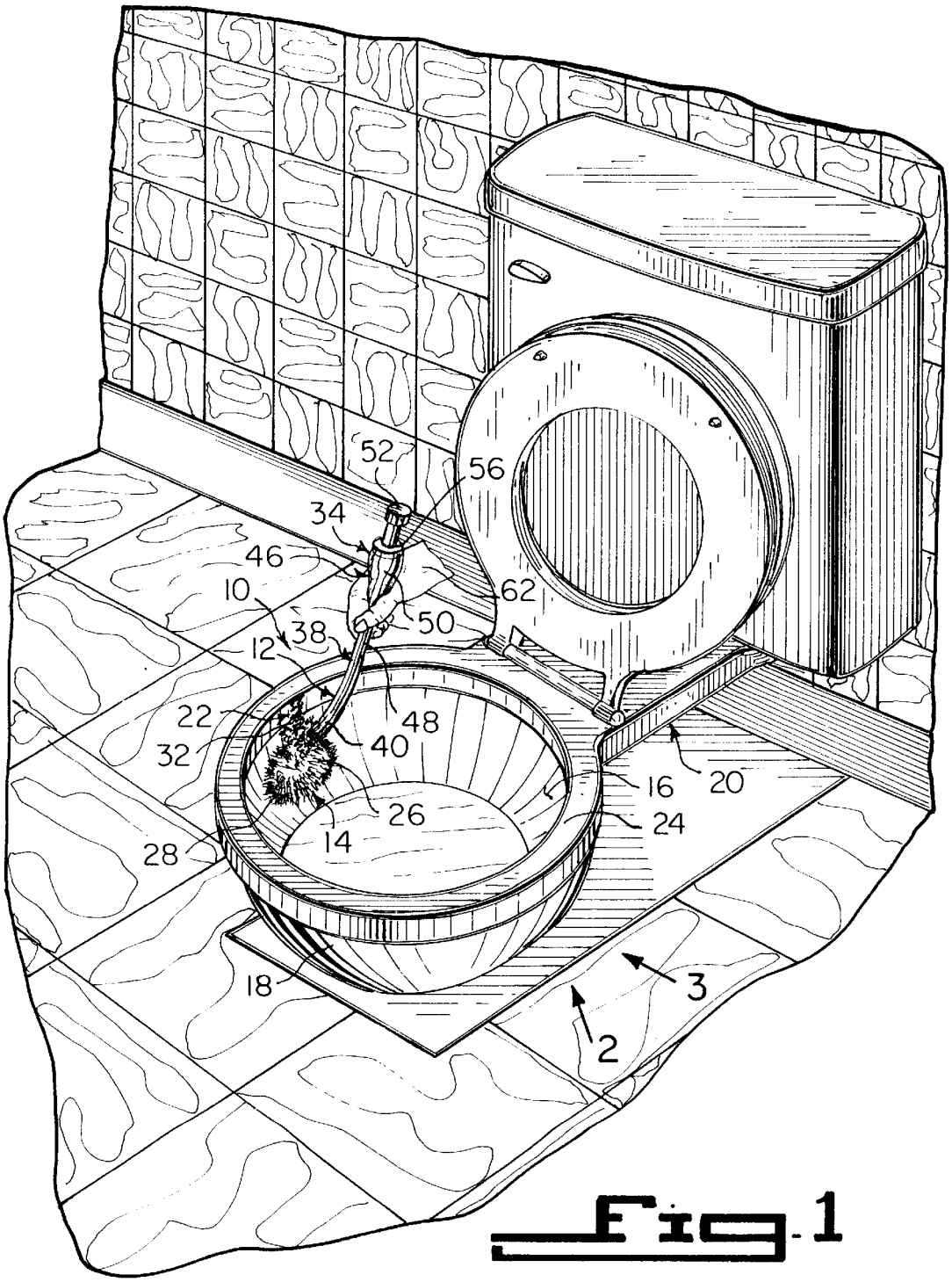
FIG. 1 is a top perspective view showing the present invention cleaning the interior of a bowl and an overhanging rim of a toilet.
Figure 2:
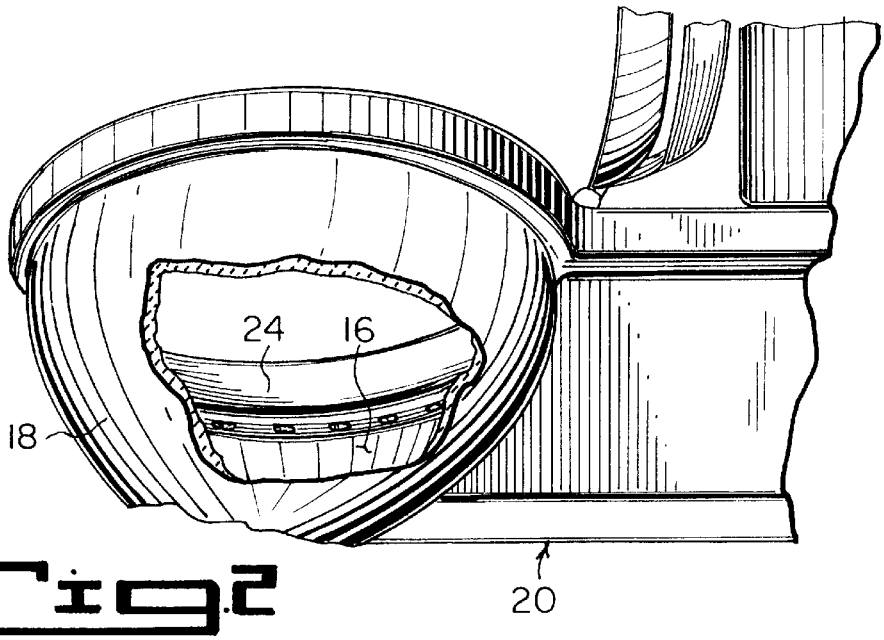
FIG. 2 is a bottom perspective view of the toilet taken in the direction of arrow 2 in FIG. 1, with parts broken away and in section.
Figure 3:
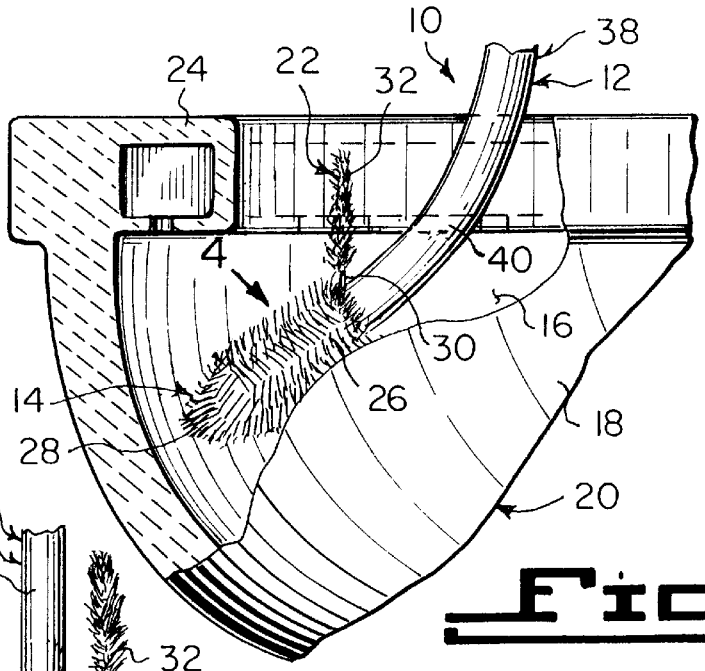
FIG. 3 is an enlarged right side view taken in the direction of arrow 3 in FIG. 1, with parts broken away and in section, showing the present invention in the cleaning position.
Figure 4:
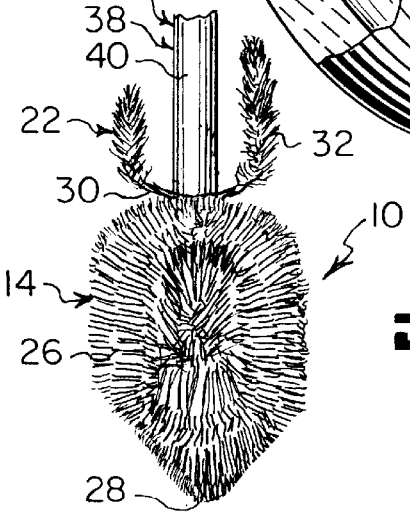
FIG. 4 is a front view taken in the direction of arrow 4 in FIG. 3, of a lower portion of the present invention.
Figures 5, 5A:
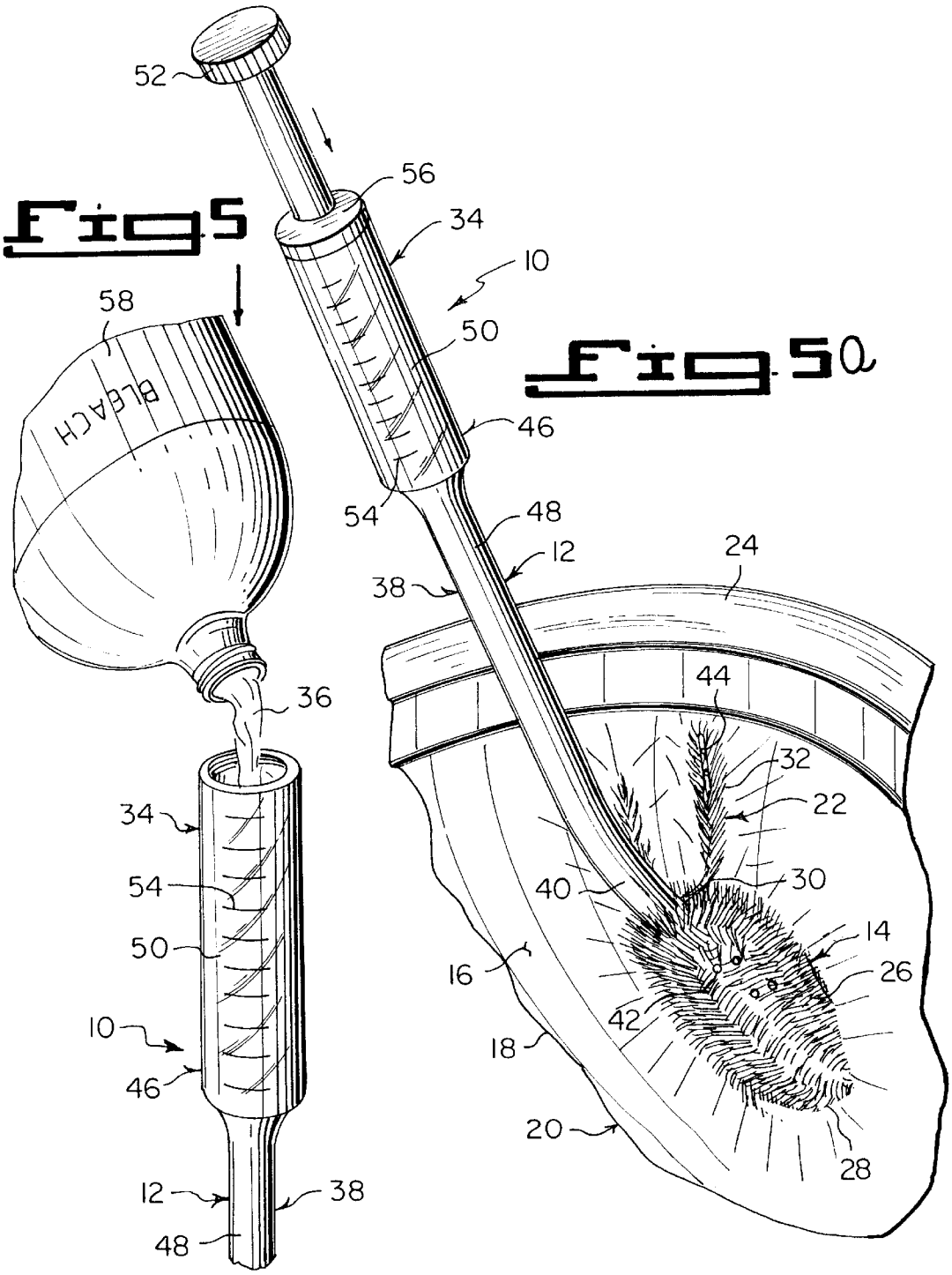
FIG. 5 is a partial perspective view showing bleach from a bottle being poured into the barrel of the syringe dispenser.

FIG. 5*a* is a perspective view showing the syringe dispenser supplying bleach to the large brush head and small brush head in the bowl, which is broken away.

Figures 6, 7, 8:
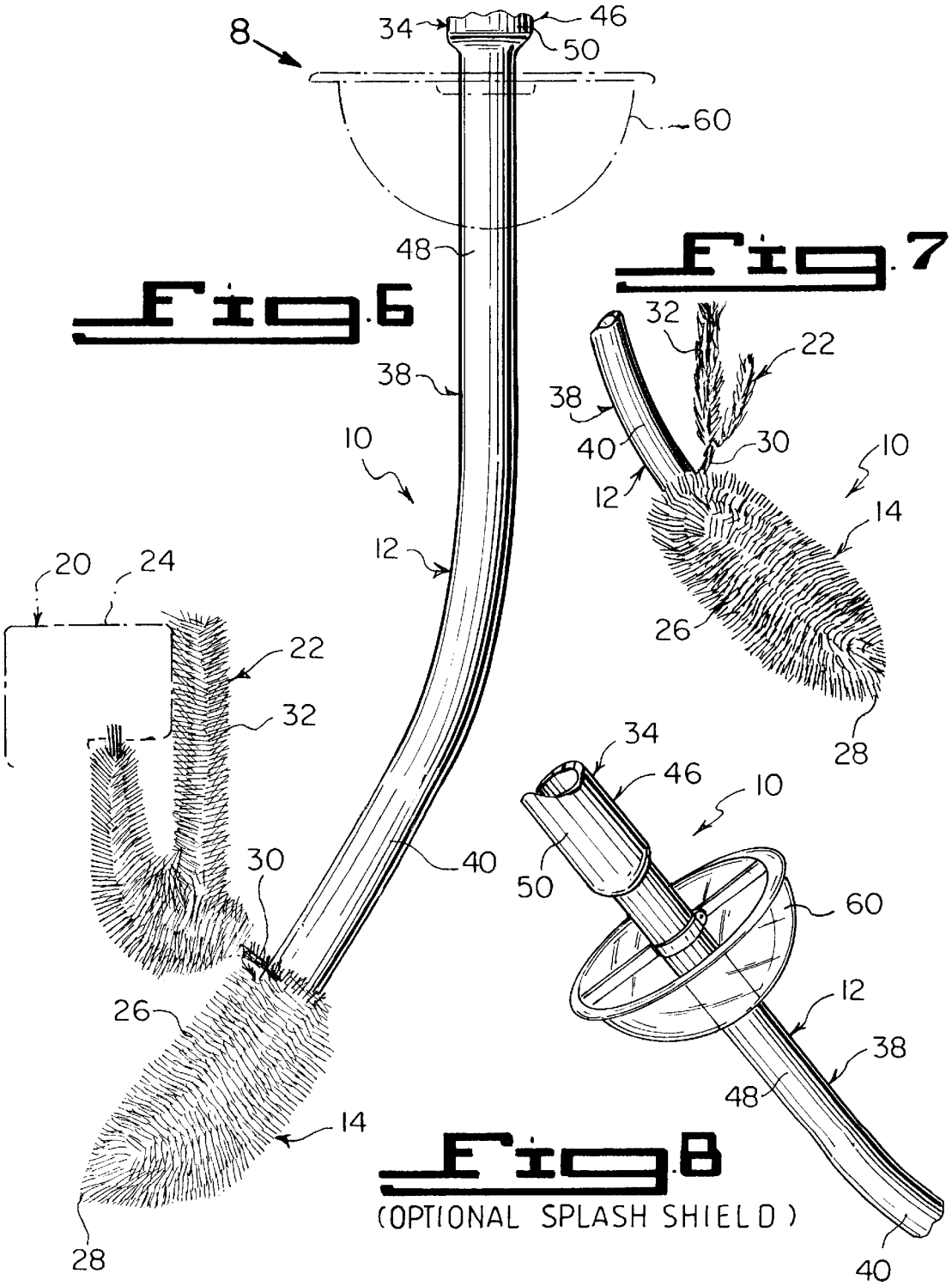

FIG. 6 is a right side view of the present invention with a portion of the barrel broken away, showing a splash shield in phantom on the elongate handle directly below the panel.

FIG. 7 is a left side view of a lower portion of the present invention.

FIG. 8 is a perspective view taken in the direction of arrow 8 in FIG. 6, showing the splash shield in greater detail, and the lower portion broken away.

Similar reference characters denote corresponding features consistently throughout the attached drawings.

DESCRIPTION OF THE PREFERRED EMBODIMENTS

Turning now descriptively to the drawings, in which similar reference characters denote similar elements throughout the several views, FIGS. 1 through 8 illustrate the present invention being a dual toilet brush 10.

The dual toilet brush 10 comprises an elongate handle 12. A first brush head 14 is connected to a first end of the elongate handle 12 for cleaning an interior surface 16 of a bowl 18 of a toilet 20. A second brush head 22 is connected to and extends outwardly from the first end of the elongate handle 12 above the first brush head 14, for cleaning an overhanging rim 24 of the toilet 20.

The first brush head 14 includes a plurality of bristles 26 affixed to and extending from the first end of the elongate handle 12. The bristles 26 of the first brush head 14 has a conoidal shaped cross section with a pointed tip 28, so as to clean the interior surface 16 of the bowl 18 of the toilet 20 in a more efficient manner.

The second brush head 22 consists of a tubular wire frame 30 attached to the first end of the elongate handle 12. A plurality of bristles 32 are secured to and extend from the tubular wire frame 30. The tubular wire frame 30 with the bristles 32 of the second brush head 22 have a J-shaped configuration, so as to clean the overhanging rim 24 of the toilet 20 in a more efficient manner.

The dual toilet brush 10 further contains an assembly 34, for dispensing bleach 36 to the first brush head 14 and the second brush head 22, so as to enhance cleaning of the interior surface 16 of the bowl 18 and the overhanging rim 24 of the toilet 20. The bleach dispensing assembly 34 includes the elongate handle 12 being a tube 38 having a curved lower portion 40 with a plurality of holes 42 there through, to which the first brush head 14 and the second brush head 22 are fluidly connected thereto. The tubular wire frame 30 has a plurality of apertures 44 there through. A syringe dispenser 46 is fluidly connected to a generally straight upper portion 48 of the tube 38. When the syringe dispenser 46 is manually operated, the bleach 36 will travel through the tube 38 and out of the holes 42 in the curved lower portion 40 into the first brush head 14, and out of the apertures 44 in the tubular wire frame 30 of the second brush head 22.

The syringe dispenser 46 consists of a barrel 50 fluidly connected to a top end of the generally straight upper portion 48 of the tube 38. The barrel 50 will hold the bleach 36 therein. A plunger 52 is in cooperation with the barrel 50 to force the bleach 36 down the tube 38, when the plunger 52 is manually pressed downwardly into the barrel 50. The barrel 50, as shown in FIGS. 5 and 5*a*, can be transparent and have a plurality of scale markings 54 thereon, so that a person can see and measure the amount of bleach 36 within the barrel 50.

The plunger 52 contains a collar 56 that is attached in a removable manner to a top end of the barrel 50. When the collar 56 is removed therefrom, bleach 36 from a bottle 58 can be poured into the barrel 50, as in FIG. 5.

A cup-shaped splash shield 60, as shown in FIGS. 6 and 8, can also be mounted to the generally straight upper portion 48 of the tube 38 directly under the barrel 50 of the syringe dispenser 46. The splash shield 60 will prevent the bleach 36 from splashing upwardly onto a hand 62 of a person grasping the barrel 50.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A dual toilet brush comprising:

a) an elongate handle;

b) a first brush head connected to a first end or said elongate handle for cleaning an interior surface of a bowl of a toilet;

c) a second brush head connected to and extending outwardly from the first end of said elongate handle above said first brush head, said second brush head having a J-shaped configuration and at an angle suitable for cleaning horizontal and vertical surfaces of an overhanging rim of the toilet while said first brush head cleans an interior surface of a bowl;

d) said second brush head including a separate tubular wire frame attached to the first end of said elongate handle and a plurality of bristles secured to and extending from said separate tubular wire frame;

e) means for dispensing bleach to said first brush head and said second brush head to enhance cleaning of the interior surface of the bowl and overhanging rim comprising said elongate handle being a tube having a curved lower portion with a plurality of holes therethrough to said first brush head, said tubular wire frame having a plurality of apertures therethrough, and said second brush head are fluidly connected thereto, and a syringe dispenser fluidly connected to a generally straight upper portion of said tube so that when said syringe dispenser is manually operated the bleach will travel through said tube and out of said holes in said curved lower portion into said first brush head and out of said apertures in said tubular wire frame of said second brush head.

2. A dual toilet brush as recited in claim 1, wherein said first brush head includes a plurality of bristles affixed to and extending from the first end of said elongate handle.

3. A dual toilet brush as recited in claim 2, wherein said bristles of said first brush head having a conoidal shaped cross section with a pointed tip, so as to clean the interior surface of the bowl of the toilet in a more efficient manner.

4. A dual toilet brush as recited in claim 1, wherein said syringe dispenser includes:

a) a barrel fluidly connected to a top end of said generally straight upper portion of said tube, said barrel will hold the bleach therein; and b) a plunger in cooperation with said barrel to force the bleach down said tube, when said plunger is manually pressed downwardly into said barrel.

5. A dual toilet brush as recited in claim 4, wherein said barrel is transparent and having a plurality of scale markings thereon, so that a person can see and measure the amount of bleach within said barrel.

6. A dual toilet brush as recited in claim 4, wherein said plunger includes a collar that is attached in a removable manner to a top end of said barrel, so that when said collar is removed therefrom, bleach from a bottle can be poured into said barrel.

7. A dual toilet brush as recited in claim 4, further including a cup-shaped splash shield mounted to said generally straight upper portion of said tube directly under said barrel of said syringe dispenser, so that said splash shield will prevent the bleach from splashing upwardly onto a hand of a person grasping said barrel.

* * * * *